United States Patent [19]

Bertin

[11] 3,995,862

[45] Dec. 7, 1976

[54] THREE-DIMENSIONAL MATHEMATICAL GAME

[76] Inventor: George Bertin, 35 W. 93rd St., New York, N.Y. 10025

[22] Filed: Aug. 18, 1975

[21] Appl. No.: 605,341

[52] U.S. Cl. ..... 273/130 AC; 273/130 B; 273/155

[51] Int. Cl.[2] ..... A63F 3/00; A63F 9/08

[58] Field of Search .... 273/130 AC, 130 R, 130 B, 273/131 AC, 132, 142 H, 142 HA, 153 R, 153 S, 155; 35/30, 31 A, 74

[56] References Cited

UNITED STATES PATENTS

| | | | |
|---|---|---|---|
| 711,959 | 10/1902 | Graham | 273/130 R |
| 2,039,332 | 5/1936 | Morrill | 273/142 HA |
| 2,313,473 | 3/1943 | Heacock et al. | 273/130 AC |
| 2,965,980 | 12/1960 | Day | 35/31 A |
| 2,988,824 | 6/1961 | Morton | 273/142 HA |
| 3,419,973 | 1/1969 | Manotas et al. | 35/31 A |
| 3,481,603 | 12/1969 | Sugden | 273/130 AC |
| 3,655,194 | 4/1972 | Pierson | 273/132 |

FOREIGN PATENTS OR APPLICATIONS

| | | | |
|---|---|---|---|
| 12,693 | 5/1897 | United Kingdom | 273/155 |
| 125,527 | 4/1919 | United Kingdom | 273/155 |

*Primary Examiner*—Richard C. Pinkham
*Assistant Examiner*—Harry G. Strappello

[57] ABSTRACT

A three-dimensional mathematical game comprises a stacked array of rotatable transparent or translucent plates, each plate being rotatable about a common vertical axis, the plates carrying indicia thereon such that when the plates are viewed through one of the top or bottom plates, there will appear to be a plurality of vertical rows of indicia. The indicia are arranged to represent a field of numbers in some numbers system to the base 2 or higher, and the game is played by rotating the plates to go from one number configuration to another.

11 Claims, 6 Drawing Figures

FIG. 1
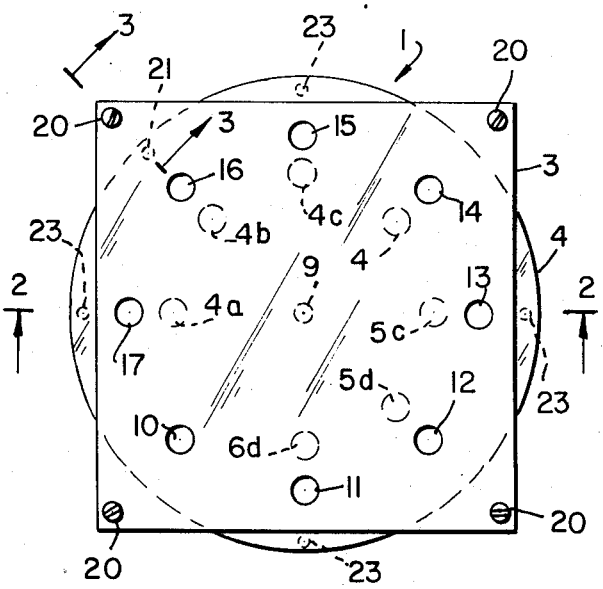
FIG. 3
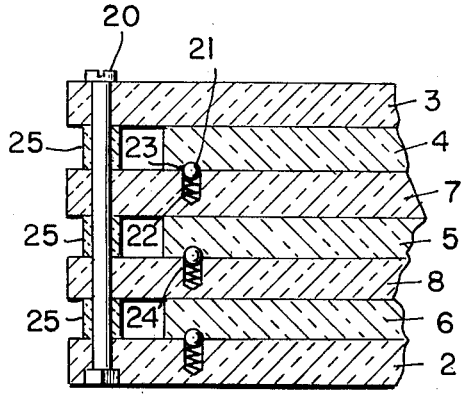
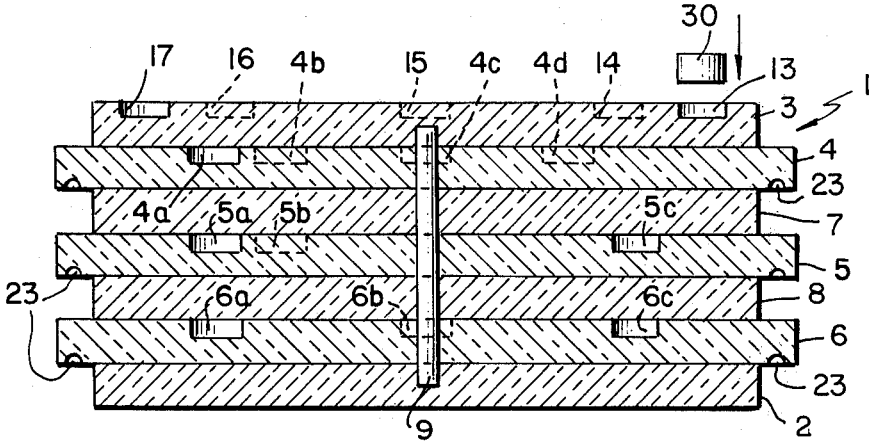
FIG. 2
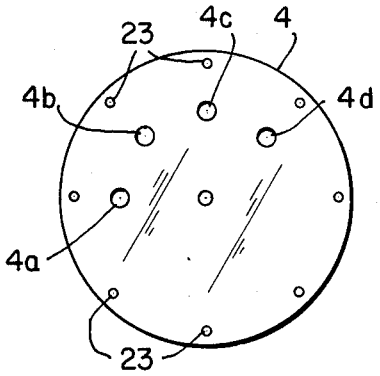
FIG. 4
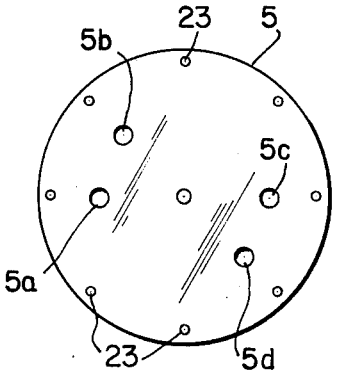
FIG. 5
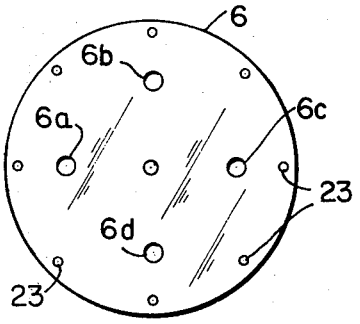
FIG. 6

THREE-DIMENSIONAL MATHEMATICAL GAME

The present invention relates to a three-dimensional mathmatical game, and more particularly to a three-dimensional game of skill based on a field of numbers represented in some number system to the base 2 or higher.

In its broadest principle, the present invention provides a vertical stacked array of transparent or translucent plates which are mounted on a support for rotation about a common vertical axis. The plates carry indicia so arranged on each plate and with respect to the indicia on the other plates such that there will appear to the observer, when he views the stacked array of plates through the top plate or through the bottom plate, as if there were at least one set of a plurality of veritcal rows of indicia equidistant from and parallel to the axis of rotation. In each vertical row, the indicia, by their combination and spatial relationship, are intended to represent a cardinal number in some numbering system with a base of 2 or higher, a field of numbers thus being displayed in each set of rows. When one plate, or each of a plurality of plates, is rotated about said axis through a predetermined number of degrees or a whole number multiple thereof, the indicia on that plate are moved from the vertical rows they occupy to other vertical rows, e.g. to adjacent vertical rows, and the field of numbers undergoes a transformation. A fixed, transparent or translucent plate, placed over one or both of the top and bottom plates and having a plurality of bores, is designed to receive markers which are intended, according to the rules of the game, to create a constraint on the sequence of transformations. A player can, therefore, attempt to go from one number configuration to another predetermined configuration through a series of transformations, or he may attempt to obtain a predetermined configuration of markers in the same way. The laws governing the transformations defined above are a legitimate field of mathematical inquiry.

In a first aspect of the present invention, the indicia on the plates may be arranged so that in at least one position of the plates relative to each other every vertical row of indicia is unique with respect to the combination and spatial relationship of the indicia in that row. Thus, in some number system to the base 2 or higher, the vertical rows can be used to designate consecutive numbers, even numbers, odd numbers, or any other group of numbers in which, in at least one position of the plates, the same number is not repeated. When the game takes this form, it may be used as a puzzle. The game may be given to the player in a position other than the position where the vertical rows are unique and he will attempt to bring the plates to such a position within the constraints imposed by the markers according to specified rules. Other puzzles can be created in this form.

In the first aspect of the invention, for $n$ plates, where $n$ is any cardinal number greater than 1, there will be a maximum of $b^n$ vertical rows, where $b$ is the base of the number system chosen, It will be seen that the maximum number of vertical rows is the total number of combinations and spatial relationships possible with a number $b$ of indicia taken $n$ at a time, $n$ being the number of plates. There will be ($b$-1) types of indicia in such a system if the absence of indicia is made to represent the integer 0 in the number system used. A vertical row containing no indicia and representing the zero row may or may not be included in the field of numbers.

In a second aspect of the invention, the indicia on the plates are arranged such that when the plates are in a first position, as well as when one plate, or each of a plurality of plates, is rotated about the axis through a predetermined number of degrees, or a whole number multiple thereof, to all other positions of the plates, and the stacked array is viewed through one of the top or bottom plates, the indicia will appear as at least one set of vertical rows of indicia equidistant from and parallel to said axis, every vertical row in a set being unique with respect to the combination and spatial relationship of the indicia in that row of said set. It will be seen that this second aspect is a species of the first aspect of the game. In a binary system, for example, this obtains when the indicia are so arranged as to have one position of the plates whereby the rows represent the number 0 and the cardinal numbers 1 to $2^n$—1 (for $n$ plates) in consecutive order from row to row. In the preferred embodiment of the invention, the game takes this aspect and uses a binary number system. This permits the game to be used as described above, and also as a "capture" game and as a wide variety of puzzles.

In a third aspect of the invention, the indicia on the plates are so arranged such that when all of the plates are in a first position, as well as when one plate, or each of a plurality of plates, is rotated about said axis through a predetermined number of degrees, or a whole number multiple thereof, to all other positions of the plates, and the stacked array is viewed through one of the top or bottom plates, the indicia will appear as at least one set of vertical rows of indicia equidistant from and parallel to said axis, the combination of the indicia in at least one row in a set being unique with respect to the levels occcupied by the indicia and their identity in that row of said set.

The present invention will be described in the accompanying drawing in terms of a second aspect capture game, in which:

FIG. 1 is a top plan view of the mathematical game of the present invention;

FIG. 2 is a view in section along the lines 2—2 in FIG. 1;

FIG. 3 is a view in section along the lines 3—3 in FIG. 1; and

FIGS. 4 through 6 are plan views of the rotatable plates used in the game and showing the indicia thereon.

For simplicity, the present invention will be discussed in terms of the game illustrated in the drawing, which, as shown in FIG. 2, comprises a support, or bottom plate 2, and a top plate 3 having therebetween rotatable plates 4, 5 and 6. Stationary spacer plates 7 and 8 are provided between the rotatable plates 4 and 5, and 5 and 6, respectively. Rotatable plates 4, 5 and 6 freely rotate about the central post 9, which is cemented or otherwise secured to base plate 2. Post 9 may also be cemented or secured to top plate 3, as shown.

Each of the plates 3 through 8, inclusive, is made of a transparent or translucent material, such as a transparent or translucent plastics material. Polycarbonate glass substitute (Lexan), cast acrylic sheet materials, such as polymethylmethacrylate (Lucite) or any other transparent or translucent plastic material may be used. In the embodiment shown in the drawings, the support plate 2 is opaque and is colored white to aid in viewing the indicia, as described below. If desired, the bottom plate 2 can also be transparent or translucent so that the indicia can be viewed through the bottom or top plate.

As seen in FIGS. 1 and 2, the top plate 3 has a plurality of bores 10 through 17 therein, constituting eight "stations." A marker 30 (FIG. 2) in the form of a disk readily sets into and is removed from any of the stations 10 through 17. Each of the plates 4, 5 and 6 has four indicia thereon, which are provided by a series of bores 4*a* through 4*d* in plate 4, 5*a* through 5*d* in plate 5 and 6*a* through 6*d* in plate 6. The vertical wall of each of the bores 4*a* . . . , 5*a* . . . , 6*a* . . . are painted with any desired color so that when the stacked array is viewed through the top plate 3, there will appear seven vertical rows of rings having one, two or three rings, the rings being provided by the painted walls of the bores 4*a* . . . , 5*a* . . . , 6*a* . . . The painted walls of the bores 4*a* . . . , 5*a* . . . through 6*a* . . . are the most preferred indicia since they combine the attributes of being extremely visible when the various plates are viewed through the top plate, either perpendicularly or obliquely thereto. When viewed from above, the rings appear as thin two-dimensional rings, and when viewed obliquely through the top plate, they appear as small cylinders. The painted walls also enable the indicia on lower plates to be readily viewed without indicia on the upper plates blocking or partially obliterating lower indicia. Other forms of indicia could be used, such as rings painted onto the plates or other printed or painted designs, etc., but the indicia should be selected so as to permit the player to view enough of the indicia in any vertical row so as to be able to confirm and identify the presence of indicia in that row.

In the initial starting position shown in the drawing, there will be one ring at stations 11, 12 and 14, two rings at stations 13, 15 and l6 and three rings at station 17 forming, in binary nomenclature, the numbers 1 through 7 at stations 11 through 17, respectively. There will be no rings at station 10, corresponding to the number zero. If the bottom disk 6 is assigned the value $2^0$, the middle disk 5 the value $2^1$ and the top disk 6 the value $2^2$, then the following Table I shows how these binary numbers are formed by using a zero to indicate the absence of indicia on a disk and the numeral 1 to indicate the presence of an indicia on a disk.

TABLE I

| Station | Plate 4 | Plate 5 | Plate 6 | Binary Number |
|---|---|---|---|---|
| 10 | 0 | 0 | 0 | 0 |
| 11 | 0 | 0 | 1 | 1 |
| 12 | 0 | 1 | 0 | 2 |
| 13 | 0 | 1 | 1 | 3 |
| 14 | 1 | 0 | 0 | 4 |
| 15 | 1 | 0 | 1 | 5 |
| 16 | 1 | 1 | 0 | 6 |
| 17 | 1 | 1 | 1 | 7 |

Since there are three disks shown, the maximum number of vertical rows of indicia is eight. The arrangement shown employs the number 0 represented by the absence of indicia on all levels, and the numbers 1 through 7 in binary nomenclature. In the "starting position" shown in the drawing, the numbers appear in numerical order from 0 to 7 from station 10 to 17.

The plates 2 through 8 are held together by four fasteners 20 passed through the plates 2, 3, 7 and 8, and spacers 25 are provided to maintain the desired spacing between plates 3, 7, 8 and 2 so that the plates 4, 5 and 6 may freely rotate about the post 9. A set of three click stops is provided adjacent one of the fasteners 20, each click stop comprising a ball 21 and a spring 22 in recesses 23 and 24 of adjacent pairs of rotatable plates and spacers, namely 4 and 7, 5 and 8, and 6 and 2. The click stops permit the rotatable plates 4, 5 and 6 to be freely rotated, and a click is sounded when the ball 21 is urged into recess 23 carried by the plates 4, 5 and 6. There are eight recesses 23 in each of the plates 4, 5 and 6 corresponding to the bores 10 to 17, so that when any plate is rotated from one recess 23 to the next, the click stop will cause the indicia carried by that plate to be vertically aligned with indicia on other plates above or below. The click stops are desirable to insure this vertical alignment, but the player of the game can vertically align the indicia by eye without the need for the click stops. The balls 21 may be made of any desired material, such as steel, and the ball 21 and spring 22 click stops are the preferred click stop means, since they are simple and quite effective, and yet easy to assemble.

The play of the game is as follows. The plates are arranged in any given starting position, and for consistency of play, they should be arranged in the same starting position each time. A convenient starting position is as shown in the drawings whereby the numbers 0 through 7 are set forth in numerical order starting from station 10 and proceeding counter-clockwise through station 17. The player with the first move rotates a desired plate clockwise or counter-clockwise through one click stop to form a vertical row having three indicia therein. In the case illustrated in the drawings, this can be done by rotating plate 4 clockwise so that the indicia 4*d* in plate 4 will be moved from its position adjacent station 14 to the new position adjacent station 13. There will then be three indicia in a vertical row adjacent station 13, namely the indicia 4*d*, 5*c* and 6*c*. The player inserts a marker 30 (FIG 2) into station 13 to signify that this position has been captured. The markers 30 bear one color on one side and a different color on the other side, or other similar forms of identifying when a position is captured by a given player. In the preferred embodiment, each player chooses a color for his side, and in the illustration just given, the marker 30 is placed into the recess designating station 13 with his color facing up to desingnate that he has captured this station. The player then has the option of continuing to capture additional stations by moving any of the plates 4, 5 and 6 or he can pass the turn to his opponent. A turn ends after a player has made at least one capture or when it is not possible to capture any new stations.

The first player to move captures stations that have no markers therein. The second and subsequent moves will present the player with the option to capture either a station having no marker or a marker bearing the color of his opponent. In the latter case, the marker in such station is turned over to indicate that this station is now owned by the other player.

It is required that every move must result in a capture, but a player is not permitted to recapture a position that he already occupies. Hence, the player must capture a vacant station or a station occupied by his opponent's marker, or, failing this, must pass the turn to his opponent.

The game ends when all stations are occupied by markers, and the winner is the player having the most stations captured. A draw is obtained when each player has the same number of captured stations.

While the above description sets forth the preferred rules of the mathematical game, other rules may be employed.

An advantage of arranging the indicia such that there is one position of the plates where the vertical rows of indicia designates zero and consecutive numbers from 1 to $b^n-1$, is that rotation of any of the $n$ plates will always result in the same numbers with the base $b$ being present, although obviously in a different order or position with respect to the stations. It has been found that the use of three plates together with the consecutive binary numbers from 0 to 7 provides a game of no mean sophistication and complexity, despite the apparent simplicity of the game, both in terms of its appearance and the brevity of its rules. It is preferred, therefore, that the game take the form shown in the drawing. If, moreover, the markers are individually identified on both colored sides with corresponding numbers, a great variety of puzzles can be devised by changing the rules of capture.

It will be seen that, for the rules described in the illustrated example to apply, it is necessary only that one unique row of indicia be always present in all positions of the movable plates relative to each other. This is the third aspect of the game, namely wherein the indicia on the plates are arranged so that in any position of the plates relative to each other at least one vertical row of indicia presents a combination and spatial relationship of indicia different from that in all the other rows, although not necessarily in the same position with respect to the stations when the plates are rotated. Table II below illustrates the case where two levels are used in the binary system to form, all positions of the plates, only one row representing the number 3 :

TABLE II

| Station | Plate Top | Plate Bottom | Binary Number |
|---|---|---|---|
| a | 0 | 0 | 0 |
| b | 0 | 0 | 0 |
| c | 0 | 1 | 1 |
| d | 1 | 0 | 2 |
| e | 1 | 0 | 2 |
| f | 1 | 1 | 3 |

While the illustrated example is based on the binary system, clearly such need not be the case. Games with different degrees of difficulty may be created with other number systems. Tables III and IV below show how the indicia can be placed on two plates to form two relatively simpler games based on the ternary number system.

TABLE III

| Station | Plate Top | Plate Bottom | Ternary Number |
|---|---|---|---|
| a | 0 | 0 | 0 |
| b | 0 | 1 | 1 |
| c | 0 | 2 | 2 |
| d | 1 | 0 | 3 |
| e | 1 | 1 | 4 |
| f | 1 | 2 | 5 |
| g | 2 | 0 | 6 |
| h | 2 | 1 | 7 |
| i | 2 | 2 | 8 |

TABLE IV

| Station | Plate Top | Plate Bottom | Ternary Number |
|---|---|---|---|
| a | 1 | 0 | 3 |
| b | 1 | 1 | 4 |
| c | 1 | 2 | 5 |
| d | 2 | 0 | 6 |
| e | 2 | 1 | 7 |
| f | 2 | 2 | 8 |

In the ternary system, the indicia 1 and 2 can be represented by rings of different colors, and the zero represented by the absence of an indicium.

As the levels and the base of the number system are increased, games of rapidly increasing complexity can be devised.

What is claimed is:

1. A multi-level, three-dimensional game, which comprises:

a. a plurality of transparent or translucent plates arranged in a vertically stacked array, each plate constituting one level and each plate being rotatable about a common vertical axis of rotation;

b. support means for mounting the plates for rotation about said axis;

c. indicia on the plates arranged such that when the plates are in at least one position, relative to each other, and the stacked array is viewed through one of the top or bottom plates, the indicia will appear as at least one set of vertical rows of indicia equidistant from and parallel to said axis, the combination of indicia and their spatial relationship in each row in a set being unique, the rows representing numbers in a number system with base $b$ larger than 1, where $b$ is a cardinal number.

2. The game according to claim 1, wherein said indicia are arranged such that when all of the plates are in a first position, as well as when one plate, or each of a plurality of plates, is rotated about said axis through a predetermined number of degrees, or a whole number multiple thereof, to all other positions of the plates, and the stacked array is view through one of the top or bottom plates, the indicia will appear as at least one set of vertical rows of indicia equidistant from and parallel to said axis, the combination of the indicia in each row in a set being unique with respect to the levels occupied by the indicia and their identity in that row of said set.

3. The game according to claim 2, wherein there is only one set of vertical rows.

4. The game according to claim 1, wherein for $n$ plates and a number system with a base $b$, there are $b^n$ of said vertical rows, where $n$ is a cardinal number.

5. The game according to claim 4, wherein said vertical rows indicate the number zero and the cardinal numbers from 1 to 7 in binary form, the bottom plate representing the $2^0$ place, the middle plate the $2^1$ place and the top plate the $2^2$ place, the absence of an indicium being a 0 and the presence of an indicium in a row being a 1.

6. The game according to claim 5, wherein there is one position of the plates, relative to one another, where the vertical rows indicate said numbers from 0 to 7 in consecutive order proceeding from row to row.

7. The game according to claim 6, wherein the indicia are viewable through the top plate and a stationary, transparent or translucent cover plate overlies the top plate, the cover plate having eight holding means, there being one such holding means adjacent to each said vertical row, each holding means being operable to releasably hold a marker.

8. The game according to claim 7, wherein means is provided for indicating that a plate has been rotated to move an indicia thereon from one row to the next adjacent row.

9. The game according to claim 8, wherein said indicating means are click stop means.

10. A multi-level, three dimensional game, which comprises:

a. a plurality of transparent or translucent plates arranged in a vertically stacked array, each plate constituting one level and each plate being rotatable about a common vertical axis of rotation;

b. support means for mounting the plates for rotation about said axis;

c. indicia on plates such that when all of the plates are in a first position, as well as when one plate, or each of a plurality of plates, is rotated about said axis through a predetermined number of degrees, or a whole number multiple thereof, to all other positions of the plates, and the stacked array is viewed through one of the top or bottom plates, the indicia will appear as at least one set of vertical rows of indicia equidistant from and parallel to said axis, the combination of the indicia in at least one row in a set being unique with respect to the levels occupied by the indicia and their identity in that row of said set.

11. The game according to claim 10, wherein there is a fixed, transparent or translucent cover plate over at least one of the top and bottom plates, said cover plate having a plurality of holding means, each holding means being operable to releasably hold a marker.

* * * * *